United States Patent [19]

Crisci

[11] Patent Number: 4,687,114

[45] **Date of Patent: * Aug. 18, 1987**

[54] TAMPER INDICATING CLOSURE FOR CONTAINERS

[75] Inventor: Robert E. Crisci, New Castle, Pa.

[73] Assignee: Northern Engineering and Plastics Corp., New Castle, Pa.

[ * ] Notice: The portion of the term of this patent subsequent to May 26, 2004 has been disclaimed.

[21] Appl. No.: 820,006

[22] Filed: Jan. 21, 1986

[51] Int. Cl.[4] ..... B65D 53/00

[52] U.S. Cl. ..... 215/256; 215/344; 215/DIG. 1

[58] Field of Search ..... 215/256, 254, 344, DIG. 1

[56] References Cited

U.S. PATENT DOCUMENTS

| | | | |
|---|---|---|---|
| 3,893,583 | 7/1975 | McLaren | 215/256 |
| 3,907,146 | 9/1975 | Fields | 215/344 X |
| 4,089,463 | 5/1978 | Babiol | 215/344 X |
| 4,202,455 | 5/1980 | Faulstich | 215/31 |
| 4,307,821 | 12/1981 | McIntosh | 215/256 X |
| 4,561,553 | 12/1985 | Crisci | 215/256 |

FOREIGN PATENT DOCUMENTS

G 11668 10/1956 Fed. Rep. of Germany ..... 215/256

*Primary Examiner*—Donald F. Norton
*Attorney, Agent, or Firm*—Harpman & Harpman

[57] ABSTRACT

A flexible closure for a container such as a blow molded jug having an inturned flange surrounding an opening therein and a pair of vertically spaced fastening configurations on the neck of the container, the closure having a resilient cap portion with an annular flange depending therefrom, vertically spaced fastening configurations on said annular flange positioned for registry with said fastening configurations on said neck, a lower portion of said annular flange forming a tear skirt. The fastening configurations on the neck of the container and the fastenign configurations on the annular flange of the flexible closure forming dual fasteners, either of which is capable of holding the closure on the neck of the container. One or more resilient flexible depending ribs on the resilient cap portion sealingly engage said inturned annular flange surrounding said opening.

4 Claims, 8 Drawing Figures

TAMPER INDICATING CLOSURE FOR CONTAINERS

BACKGROUND OF THE INVENTION

1. Technical Field

This invention relates to tamper indicating closures for containers such as blow molded plastic jugs which are widely used in the dairy industry for the expendible packaging of dairy products, such as milk.

2. Description of the Prior Art

Prior closures of this type may be seen in U.S. Pat. Nos. 3,893,583, 4,202,455, and 4,307,821.

The present invention provides dual fastening of a flexible resilient molded plastic tamper indicating snap-on closure in that the closure includes a top portion with a first depending annular flange having oppositely disposed, outturned and inturned annular flanges on its lower edge, one of which forms a first fastening configuration and the other forms an annular shoulder when the tear skirt is removed.

Resilient depending annular ribs on the closure form a liquid seal when the closure engages the upper surface of an inturned annular flange around the opening in the container.

SUMMARY OF THE INVENTION

A tamper indicating closure for a container such as a blow molded jug with appropriate neck configurations takes the form of a resilient flexible cap portion having a top with a first annular depending flange on its peripheral edge and an inwardly spaced depending annular rib. Outturned and inturned annular flanges are formed on the lower edge of the first annular depending flange of the cap portion and a second annular depending flange of larger diameter than the first annular depending flange is formed on said outturned annular flange. First and second annular grooves are formed in the inner surface of the second annular depending flange so as to define a second fastening configuration and an annular thin frangible wall. The portion of the second annular depending flange below the frangible wall forms a tear skirt. A pull tab is integrally formed with the tear skirt and a vertical groove is formed in the tear skirt adjacent the pull tab. An outturned angular flange is formed on the lower edge of said tear skirt and a plurality of circumferentially spaced gussets are positioned between said angular flange and said tear skirt.

DESCRIPTION OF THE PREFERRED EMBODIMENT

Figure 4:
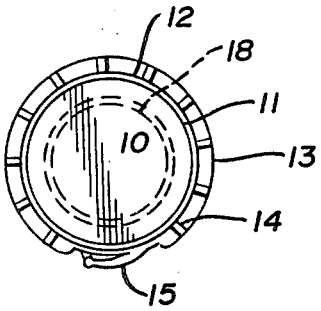
FIG. 4 is a top plan view of the tamper indicating closure showing the pull tab.
Figure 5:
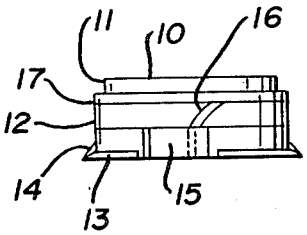
FIG. 5 is a side elevation of the tamper indicating closure showing the pull tab and a diagonal tear groove in the tear skirt.

By referring to the drawings and FIGS. 4 and 5 in particular, a top plan view and a side elevation of the tamper indicating closure may be seen, the closure including a top portion 15 with a relatively short first depending annular flange 11 and a second depending annular flange 12, the lower edge of which has an outturned annular flange 13 formed on a majority of its annular edge. Several circumferentially spaced gussets 14 join the angular flange 13 and the second annular depending flange 12. A pull tab 15 is attached to the depending annular flange 12 in the area between the ends of the outturned angular flange 13.

As illustrated in FIG. 5 of the drawings, the second annular depending flange 12 which is of a larger diameter than the first annular depending flange 11 is provided with a tear groove 16, the lower portion of which extends substantially vertically alongside the end of the pull tab 15 and the upper portion of which runs at an angle with respect thereto upwardly to a first annular groove 17 in the second annular depending flange 12 and positioned just below the point of engagement thereof with respect to the first annular depending flange 11 of the closure.

Figure 1:
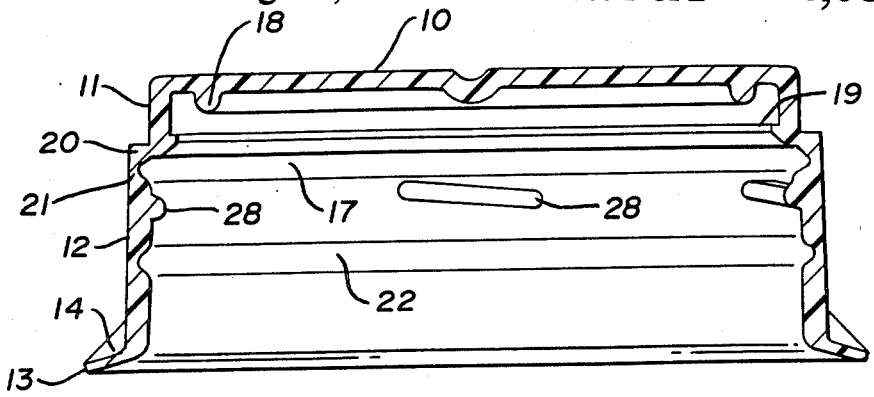
FIG. 1 is a vertical section of the tamper indicating closure.

By referring to FIG. 1 of the drawings, an enlarged vertical section of the tamper indicating closure may be seen to comprise a circular, relatively flat resilient top portion 10, the relatively short first annular depending flange 11, which depends from the peripheral edge of the top portion 10, the second annular depending flange 12, together with the outturned angular flange 13 and it will be observed that there is a depending annular sealing rib or bead 18 that depends from the circular relatively flat top portion 10 radially spaced inwardly from the first annular depending flange 11 of the closure. The depending annular rib 18 is a slightly elongated, half-circular shape in cross section. The first annular depending flange 11 will be observed to be of smaller diameter than the second annular depending flange 12 and it is provided with an inturned flange 19 which forms a first fastening flange. An oppositely disposed outturned flange 20 defines the difference in diameters of the first annular depending flange 11 and the second annular depending flange 12 and the inturned annular fastening flange 19 being oppositely disposed with respect to the outturned flange 20 stiffens this portion of the closure. The annular depending flange 12 below the outturned flange 20 is formed on a substantially vertical plane of an increased wall thickness with respect to the wall thickness of the first annular depending flange 11 and the circular relatively flat resilient top portion 10 of the tamper indicating closure.

The first annular groove 17 in the second annular depending flange 12 just below the outturned flange 20 being sufficiently deep that it creates a thin frangible connecting wall 21 and thereby defines the tear skirt which comprises all of the second annular depending flange 12 below the first annular groove 17. There is a second annular groove 22 in the second annular depending flange which forms a second fastening configuration.

Figure 2:
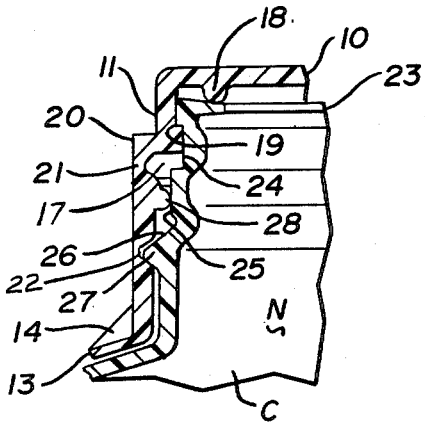
FIG. 2 is a vertical section through a portion of the tamper indicating closure and a portion of a neck of a container on which the closure is applied showing the dual fastening means and the depending sealing rib.

By referring now to FIG. 2 of the drawings, a portion of a container C having a neck N may be seen. The configuration of the neck N having an inturned tapered top flange 23, an annular flat shallow groove 24 on the exterior thereof and spaced downwardly with respect to the upper end of the neck portion of the container and an annular flat wall section 25 immediately therebelow, the lower portion of which joins an outwardly angling section 26 which extends into an annular rib 27. The annular rib 27 and the flat shallow groove 24 of the neck portion of the container form two fastening configurations which register with the second annular groove 22 and the inturned fastening flange 19 respectively of the closure. It will be seen that by simply pushing the closure downwardly on the neck N of the container C brings the dual fastening configurations just described into interlocking relation thus securely positioning the closure on the container neck. At the same time, the depending annular sealing rib 18 on the closure registers with the upper surface of the inturned flange 23 which defines the opening of the neck N of the container.

Figure 3:
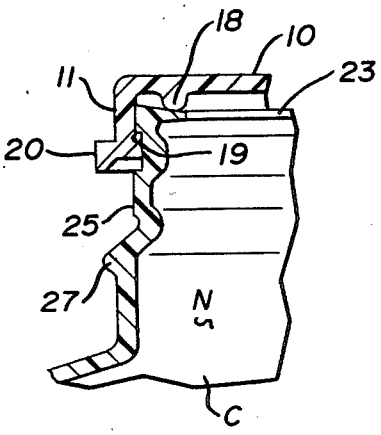
FIG. 3 is a vertical section through a portion of the tamper indicating closure after the tear skirt has been removed and showing the closure on a portion of the neck of a container in sealing relation.

By referring now to FIG. 3 of the drawings, a vertical section of a portion of the container C and neck N thereof may be seen with the upper portion of the tamper indicating closure positioned thereon in sealing relation. In FIG. 3 of the drawings, the tear skirt, which is the majority of the second annular depending flange 12 has been removed leaving the circular relatively flat resilient top 10 with the first annular depending flange 11 thereon including the oppositely disposed outturned flange 20 and the inturned fastening flange 19 on the lower edge thereof which is illustrated in engagement with the upper portion of the flat shallow groove 24 of the neck portion of the container. The engagement of the depending annular sealing rib 18 with the upper surface of the tapered inwardly extending flange 23 of the neck portion N being maintained.

The engagement of the inturned fastening flange 19 of the closure with the upper portion of the flat shallow groove 24 of the neck portion N is sufficient to hold the closure as shown in FIG. 3 on the container at all times including dropping a container of a one gallon size filled with liquid, such as milk, on a hard surface, such as a floor, from an elevated height. The proximity of the fastening flange 19 to the outturned annular flange 20 limits the distortion of this portion of the closure and thus insures the liquid tight seal which is so highly desirable when the closure in its abbreviated form is replaced on the container.

It will be seen that when the tamper indicating closure disclosed herein is positioned downwardly on the neck of a container such as a blow molded plastic jug, the dual fastening configurations snap into position simultaneously and without interfering with one another. As the closure is moved downwardly over the neck N of the container, the major portion of the second annular depending flange 12 is spaced outwardly or radially of the flat shallow groove 24 and the annular flat wall 25 of the neck portion N so that they do not engage the same, but move downwardly freely until the second annular groove 22 which comprises the second fastening configuration registers with the annular rib 27 of the neck portion N of the container. Simultaneously, the upper portion of the closure has moved downwardly until the inturned annular fastening flange 19 snaps into the upper part of the flat shallow groove 24. The closure is formed of resilient molded plastic material.

It will occur to those skilled in the art that in order to remove the closure from the neck of the container it is necessary to grasp the pull tab 15 as shown in FIG. 4 of the drawings and move it from left to right which causes the lower portion of the annular depending flange 12 of the closure which forms the tear skirt to separate on the line of the groove 17 which is formed in the innner surface of the depending annular flange 12 as hereinbefore described. Continued movement of the pull tab 15 left to right as seen in FIG. 4 of the drawings and thence circumferentially of the closure on the neck portion of the container causes the tear skirt, which is the lower portion of the second annular depending flange 12, to separate the thin connecting wall 21 where it is defined by the first annular groove 17. The annular depending flange 12 below the first annular groove 17 is thus removed completely from the closure leaving the remaining portion of the closure as seen in FIG. 3 complete with its first fastening flange 19 intact upon the neck N of the container. The provision of the outturned flange 17 and the increased diameter of the annular depending flange 12 forms a convenient annular shoulder therebeneath which tapers upwardly and inwardly as best seen in FIG. 3 of the drawings and which is particularly useful in removing the remaining portion of the closure from the neck N of the container as it permits a person's fingers to be positioned thereinunder and the edge of the closure lifted including the necessary distortion of the closure to free the inturned annular fastening flange 19 of the closure from its seat in the groove 24 on the neck of the container.

By referring again to FIG. 1 of the drawings, it will be seen that several circumferentially spaced angularly positioned ribs 28 are illustrated as being formed on the inner surface of the second annular depending flange 12 of the closure and just below the first annular groove 17 which forms the frangible connecting wall 21 therein. These angularly disposed ribs 28 have two functions. When the closure is formed with these ribs 28, they serve to space the second annular depending flange at circumferentially spaced areas with respect to the annular flat wall 25 of the neck N of the container and thus prevent distortion of the same with respect thereto. Secondly, the neck N of the container may be provided with matching rib-like configurations of the annular flat wall 25 as disclosed herein whereupon the ribs 28 may assist the removal of the closure from the neck N of the container by twisting the closure while simultaneously removing the tear skirt portion of the second annular depending flange 12 thereof.

Figure 6:
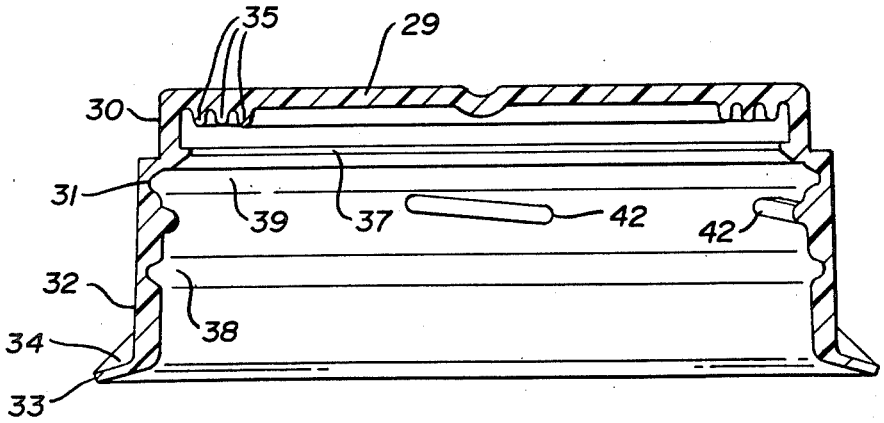
FIG. 6 is a vertical section of a modified tamper indicating closure with the depending annular sealing rib.
Figure 7:
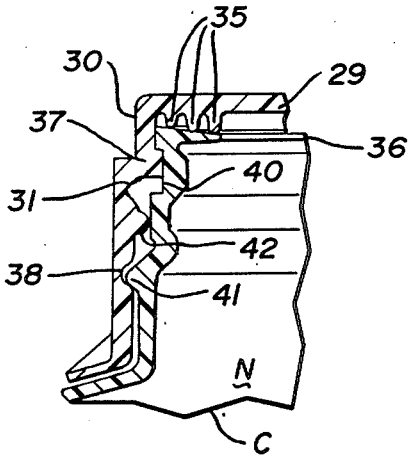
FIG. 7 is a vertical section of a portion of the modified closure of FIG. 6 on a portion of a neck of a container.
Figure 8:
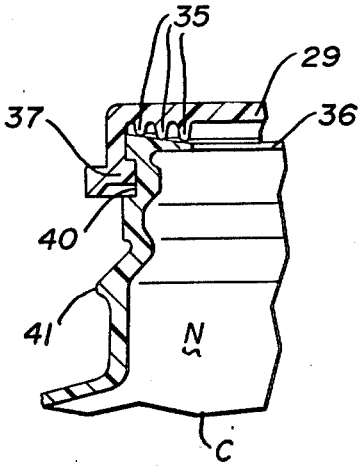
FIG. 8 is a vertical section of a portion of the modified closure of FIG. 7 with the tear skirt removed.

A modification of the closure may be seen in FIGS. 6, 7 and 8 of the drawings wherein a closure including a resilient top portion 29 with a relatively short first annular depending flange 30 has a frangible thin wall 31 joining a tear skirt 32, the lower edge of which has an outturned angular flange 33. Circumferentially spaced gussets 34 join the flange 33 and the tear skirt 32 and maintain the position of the flange 33 when the closures are stripped from the mold. Several depending annular resilient ribs 35 are formed on the lower inner surface of the top portion 29 for sealing engagement with the upper surface of an inturned annular flange 36 which may be tapered as seen in FIGS. 7 and 8 of the drawings.

The several depending annular resilient ribs 35 on the closure top portion 29 are preferably at least cross sectionally half round annular shapes which with the resilient elastic top portion 29 of the closure form a plurality of annular seals on the inturned flange 36 of a blow molded container or bottle. The annular ribs 35 are of different diameters and depend from top portion 28 of the closure in different lengths. The closure seen in FIGS. 6, 7 and 8 has the same novel dual fastening means for engaging registering dual fastening means on the neck of a container or bottle as hereinbefore described in connection with FIGS. 1–5 of the drawings. These dual fastening means on the closure comprise an inturned flange 37 and an inwardly facing groove 38 separated by another inwardly facing groove 39 which also defines the thin frangible wall 31. The flange 37 and groove 38 register with a shallow groove 40 and annular rib 41 respectively on the neck N of the container C as seen in FIGS. 7 and 8 of the drawings.

In FIGS. 6 and 7 circumferentially spaced thread-like angular ribs 42 on the inside of the resilient tear skirt 32 of the closure can be engaged on similarly shaped angular ribs which may be formed on the neck N of the container C so that twisting rotary motion applied to the closure will remove it from the neck of the container when the tear skirt 32 is removed.

It will thus be seen that the tamper indicating closure for containers disclosed herein has several points of novelty with respect to the closures heretofore known in the art and in particular those which are primarily adapted for use on blow molded plastic jugs such as used in the dairy industry for the packaging of milk and similar liquid products.

One of the novel features of the invention is the provision of the gussets 14 on the angular flange 13. The gussets 14 cause the molded closures to freely disengage the mold cavities when formed and eliminate the heretofore sticking of molded closures in the cavities of the multi-cavity molds.

Having thus described my invention, what I claim is:

1. A resilient molded plastic snap on tamper indicating closure and a container, said container including a neck surrounding an opening to the container, the neck defining an inner surface which extends longitudinally of the container, an inturned annular flange which extends radially into the opening and has an outer surface oriented transversely of the neck opening, the flange extending radially into the neck opening beyond the neck inner surface to define an outlet opening which can be off-center with respect to the container neck, and dual closure retaining means on said neck; said dual closure retaining means including a groove defined in said neck adjacent to said inturned annular flange; said closure comprising means for covering said opening to said container and a depending annular flange surrounding said neck, dual fastening means on said depending annular flange for engaging said retaining means and an annular frangible wall formed in said depending annular flange between said dual fastening means, said dual fastening means including a fastening flange located to engage said neck groove; a score line formed in said depending annular flange extending to said annular frangible wall and located adjacent to said fastening flange to define a tear-skirt portion which includes all of said depending annular flange below said fastening flange, said tear-skirt portion having a pull tab affixed thereto, said means for covering said opening to said container comprising a resilient disc having said depending annular flange joined thereto at the peripheral edge of said disc, at least one flexible annular sealing bead integrally formed on said resilient disc in depending relation thereto and postioned for sealing engagement with said inturned annular flange outer surface at a location which is radially inward of the innermost surface of said neck whereby an off-center opening is sealingly covered by said closure.

2. The resilient molded plastic closure and container set forth in claim 1 and wherein there are a plurality of depending annular beads on said means for covering said opening, each of said depending annular beads being of different diameters and different depending lengths.

3. The resilient molded plastic closure and container set forth in claim 1 and wherein said means for covering said opening is of a first thickness and wherein said tear skirt is of a thickness greater than said first thickness of said means for covering said opening whereby said means for covering said opening and the sealing bead thereon are relatively more distortable than said tear skirt.

4. A resilient molded plastic snap on tamper indicating closure for a container of the type having a neck surrounding an opening to the container defined by an inturned annular flange and having dual closure retaining means on said neck, said dual closure retaining means including a groove defined in said neck adjacent to said inturned annular flange; said closure comprising means for covering said opening to said container and a depending annular flange surrounding said neck, dual fastening means on said depending annular flange for engaging said retaining means, said dual fastening means including a fastening flange located on said closure to engage said groove; and an annular frangible wall formed in said depending annular flange between said dual fastening means, a score line formed in said depending annular flange extending to said annular frangible wall and located adjacent to said fastening flange to define a tear-skirt portion which includes all of said depending annular flange below said fastening flange; said tear-skirt portion having a pull tab affixed thereto, said means for covering said opening to said container comprising a resilient disc having said depending annular flange joined thereto at the peripheral edge of said disc, at least one flexible annular sealing bead integrally formed on said resilient disc in depending relation thereto and positioned for sealing engagement with said inturned annular flange, and an outturned angular flange joined to said depending annular flange in oppositely disposed relation to said resilient disc and a plurality of gussets positioned in circumferentially spaced relation to one another between said depending annular flange and said outturned angular flange.

* * * * *